US008556673B1

(12) United States Patent
Winting

(10) Patent No.: US 8,556,673 B1
(45) Date of Patent: Oct. 15, 2013

(54) PLAY BOARD SET

(76) Inventor: Linda Winting, Alpharetta, GA (US)

( * ) Notice: Subject to any disclaimer, the term of this patent is extended or adjusted under 35 U.S.C. 154(b) by 302 days.

(21) Appl. No.: 13/049,514

(22) Filed: Mar. 16, 2011

(51) Int. Cl.
*A63H 33/08* (2006.01)
*A63H 33/00* (2006.01)

(52) U.S. Cl.
USPC ..... 446/108; 446/112; 446/118; 52/64

(58) Field of Classification Search
USPC ..... 446/108, 110, 105, 112, 115, 476, 478, 446/901, 92, 129, 137; 52/64, 69–72, 79.14
See application file for complete search history.

(56) References Cited

U.S. PATENT DOCUMENTS 5,096,204 A 3/1992 Lippman
5,313,747 A * 5/1994 Sakihara ..... 52/64
5,358,252 A 10/1994 McPhaul
D381,705 S 7/1997 Panthofer
5,860,650 A 1/1999 Scobbie et al.
6,203,017 B1 3/2001 Schultz
6,527,609 B1 * 3/2003 Rowland et al. ..... 446/110
6,761,354 B2 7/2004 Pavlovits
6,871,853 B2 3/2005 Bedford
8,038,502 B2 * 10/2011 Loetz ..... 446/118

* cited by examiner

*Primary Examiner* — Kien Nguyen

(57) ABSTRACT

A play board set is provided for mounting to a wall, expanding from a storage position, and providing interchangeable background themes and play items to enhance creative interactive play. The set includes a main panel having a magnetic front face and a rear face configured for coupling to a support surface. A pair of secondary panels is pivotally coupled to the main panel. Each secondary panel has a magnetic front face and a magnetic rear face. A plurality of decorative attachments is provided. Each decorative attachment is selectively positionable on the front face of the main panel and the front or rear face of each secondary panel.

13 Claims, 4 Drawing Sheets

PLAY BOARD SET

BACKGROUND OF THE DISCLOSURE

Field of the Disclosure

The disclosure relates to play board devices and more particularly pertains to a new play board device for mounting to a wall, expanding from a storage position, and providing interchangeable background themes and play items to enhance creative interactive play.

SUMMARY OF THE DISCLOSURE

An embodiment of the disclosure meets the needs presented above by generally comprising a main panel having a magnetic front face and a rear face configured for coupling to a support surface. A pair of secondary panels is pivotally coupled to the main panel. Each secondary panel has a magnetic front face and a magnetic rear face. A plurality of decorative attachments is provided. Each decorative attachment is selectively positionable on the front face of the main panel and the front or rear face of each secondary panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
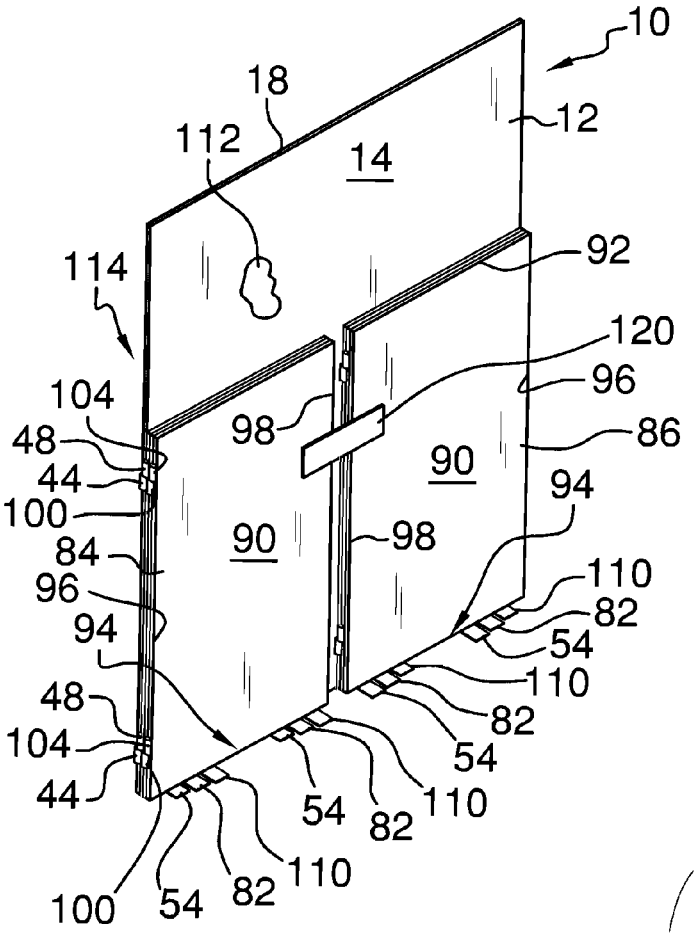
FIG. 1 is a top front side perspective view of a play board set according to an embodiment of the disclosure in a storage position.
Figure 2:
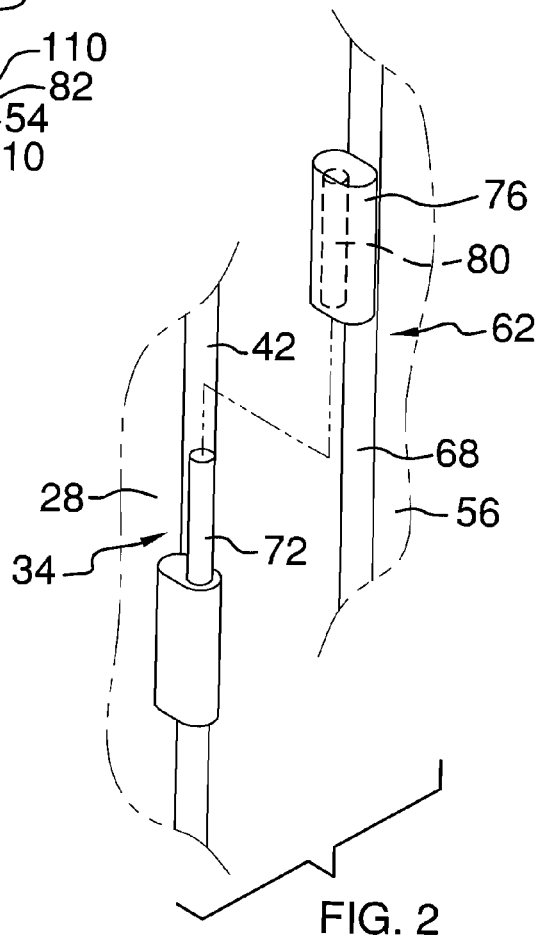
FIG. 2 is an enlarged view of a panel connection of an embodiment of the disclosure.
Figure 3:
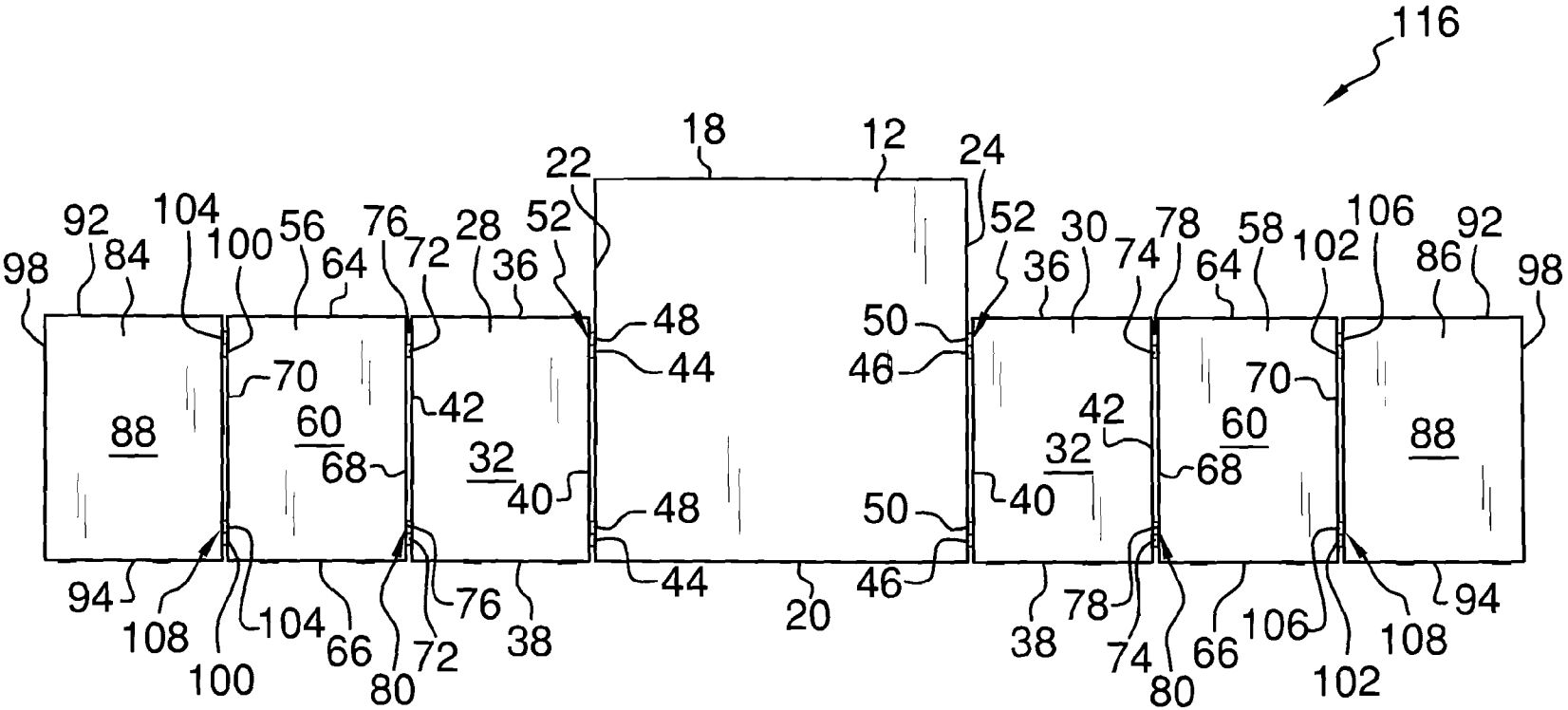
FIG. 3 is a front view of an embodiment of the disclosure in an expanded position.

With reference now to the drawings, and in particular to FIGS. 1 through 5 thereof, a new play board device embodying the principles and concepts of an embodiment of the disclosure and generally designated by the reference numeral 10 will be described.

As best illustrated in FIGS. 1 through 5, the play board set 10 generally comprises a main panel 12 having a front face 14, a rear face 16, a top edge 18, a bottom edge 20, and a pair of side edges 22,24. Each side edge 22,24 extends between the top edge 18 of the main panel 12 and the bottom edge 20 of the main panel 12. The front face 14 of the main panel 12 is magnetic. The rear face 16 is configured for coupling directly to a vertical support surface 26 such as a wall.

A pair of secondary panels 28,30 is pivotally coupled to the main panel 12. Each secondary panel 28,30 has a magnetic front face 32, a rear face 34, top edge 36, and bottom edge 38. Each secondary panel 28,30 further has a proximal side edge 40 relative to the main panel 12 extending between the top edge 36 and the bottom edge 38 of the respective secondary panel 28,30. Each secondary panel 28,30 also includes a distal side edge 42 relative to the main panel 12 extending between the top edge 36 and the bottom edge 38 of the respective secondary panel 28,30. A pair of hinge posts 44,46 is coupled to each side edge 22,24 respectively of the main panel 12. The hinge posts 44,46 are parallel to the main panel 12 to permit free pivoting of the secondary panels 28,30. A pair of post receivers 48,50 is coupled to each proximal side edge 40 of the secondary panels 28,30. Each post receiver 48,50 has a bottom opening 52 extending into the post receiver 48,50. Each post receiver 48,50 is positioned to receive an associated one of the hinge posts 44,46 through the bottom opening 52. Thus, the secondary panels 28,30 are pivotally coupled to the main panel 12.

A plurality of footings 54 is provided. Each footing 54 is coupled to the bottom edge 38 of an associated one of the secondary panels 28,30. Each secondary panel 28,30 has two of the footings 54 attached to the bottom edge 38 of the secondary panel 28,30.

Each one of a pair of tertiary panels 56,58 is pivotally coupled to one of the secondary panels 28,30 respectively. Each tertiary panel 56,58 has a magnetic front face 60, a magnetic rear face 62, a top edge 64 and a bottom edge 66. The tertiary panel 56,58 each also has a proximal side edge 68 relative to an adjacently positioned secondary panel 28,30 extending between the top edge 64 and the bottom edge 66 of the tertiary panel 56,58. Each tertiary panel 56,58 further includes a distal side edge 70 relative to the adjacently positioned secondary panel 28,30 extending between the top edge 64 and the bottom edge 66 of the tertiary panel 56,58. A pair of secondary hinge posts 72,74 is coupled to each distal side edge 42 of the secondary panels 28,30. The secondary hinge posts 72,74 are parallel to the secondary panels 28,30. A pair of secondary post receivers 76,78 is coupled to each proximal side edge 68 of the tertiary panels 56,58. Each secondary post receiver 76,78 has a bottom aperture 80 extending into the secondary post receiver 76,78 and each secondary post receiver 76,78 is positioned to receive an associated one of the secondary hinge posts 72,74 through the bottom aperture 80. Thus, the tertiary panels 56,58 are pivotally coupled to the secondary panels 28,30.

A plurality of secondary footings 82 is provided. Each secondary footing 82 is coupled to the bottom edge 66 of an associated one of the tertiary panels 56,58. Each tertiary panel 56,58 has two of the secondary footings 82 attached to the bottom edge 66 of the tertiary panel 56,58.

A pair of quaternary panels 84,86 may be pivotally coupled to the tertiary panels 56,58. Each quaternary panel 84,86 has a magnetic front face 88, a magnetic rear face 90, a top edge 92 and a bottom edge 94. Each quaternary panel 84,86 has a proximal side edge 96 relative to an adjacently positioned tertiary panel 56,58 extending between the top edge 92 and the bottom edge 94 of the quaternary panel 84,86. Each quaternary panel 84,86 further includes a distal side edge 98 relative to the adjacently positioned tertiary panel 56,58 extending between the top edge 92 and the bottom edge 94 of the quaternary panel 84,86. A pair of tertiary hinge posts 100,102 is coupled to each distal side edge 70 of the tertiary panels 56,58. The tertiary hinge posts 100,102 are parallel to the tertiary panels 56,58. A pair of tertiary post receivers 104,106 is coupled to each proximal side edge 96 of the quaternary panels 84,86. Each tertiary post receiver 104,106 has a bottom hole 108 extending into the tertiary post receiver 104,106 and each tertiary post receiver 104,106 is positioned to receive an associated one of the tertiary hinge posts 100, 102 through the bottom hole 108. Thus, the quaternary panels 84,86 are pivotally coupled to the tertiary panels 56,58.

Figure 4:
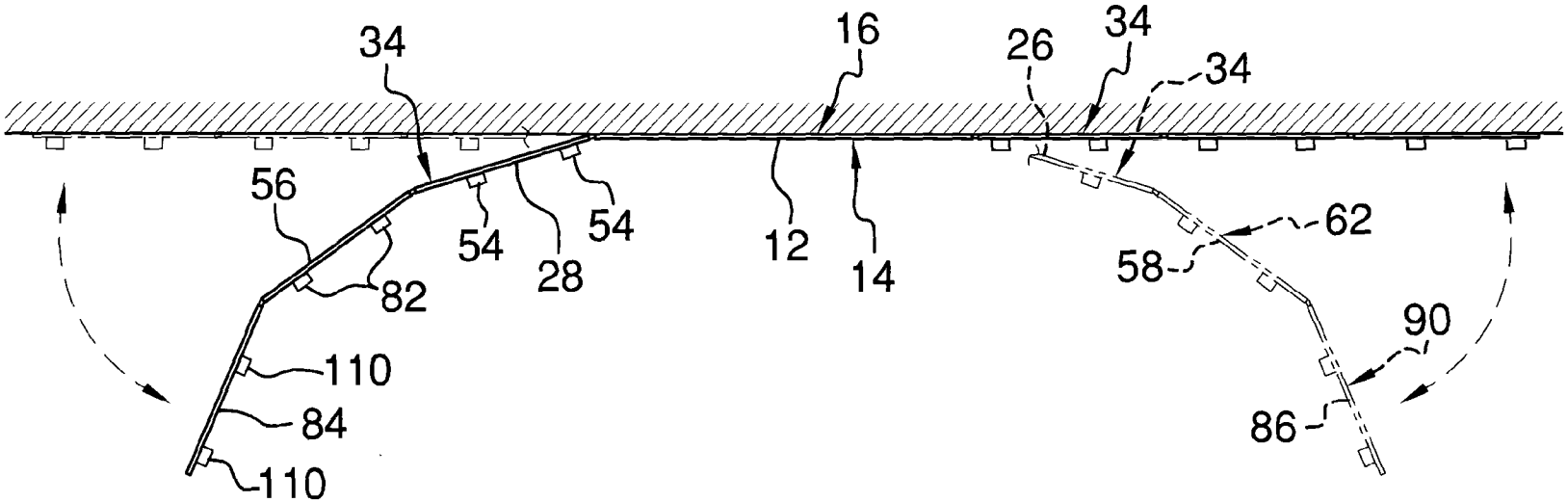
FIG. 4 is a top view of an embodiment of the disclosure in an expanded position.
Figure 5:
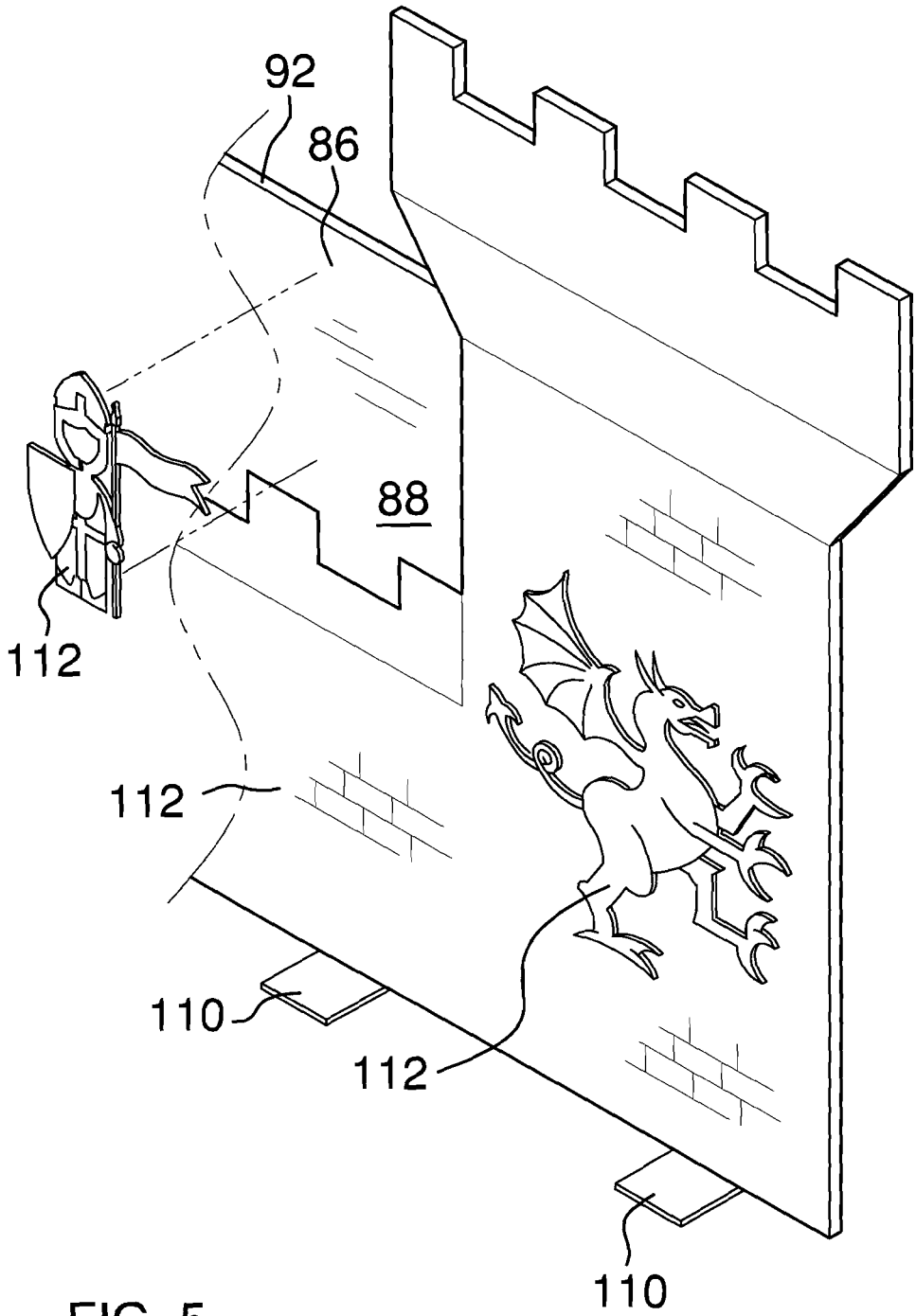
FIG. 5 is a detailed front top side perspective view of an embodiment of the disclosure.

A plurality of tertiary footings 110 is provided. Each tertiary footing 110 is coupled to the bottom edge 94 of an associated one of the quaternary panels 84,86. Each quaternary panel 84,86 has two of the tertiary footings 110 attached to the bottom edge 94 of the quaternary panel 84,86. The secondary, tertiary and quaternary panels 28,30,56,58,84,86 may be positioned as desired from a fully retracted storage position 114 as shown in FIG. 1 or an expanded position 116 as shown in FIG. 4. The footings 54,82, and 110 are offset with respect to each other to facilitate compact positioning when in the storage position 114. A closure 120 may be coupled to the quaternary panels 84,86 to secure the play board set 10 in the storage position 114.

A plurality of decorative attachments 112 is provided. Each attachment 112 is magnetic whereby each decorative attachment 112 is selectively positionable on the front faces 14,32, 60,88 of the main panel 12, secondary panels 28,30, tertiary panels 56,58, and quaternary panels 84,86 respectively. The attachments 112 may also be selectively positioned on rear faces 16,34,62, and 90 as desired. The attachments 112 may be provided in various interchangeable and intermixable designs and themes.

In use, the main panel 12 is attached to the support surface 26. The additional panels 28,30,56,58,84,86 are attached extending from the main panel 12. A child may then apply the decorative attachments 112 to create various structures and/or atmospheres to enhance creative play. Suggested or possible storylines may also be provided in written form to enhance or promote creative play relating to a theme of the decorative attachments 112. The play board set 10 may be returned to the compact storage position 114 between play sessions.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A play board assembly comprising:

a main panel having a front face, a rear face, a top edge, a bottom edge, and a pair of side edges, each said side edge extending between said top edge of said main panel and said bottom edge of said main panel, said front face of said main panel being magnetic, said rear face being configured for coupling to a support surface;

a pair of secondary panels pivotally coupled to said main panel, each secondary panel having a front face, a rear face, top and bottom edges, a proximal side edge relative to said main panel extending between said top edge and said bottom edge of said secondary panel, and a distal side edge relative to said main panel extending between said top edge and said bottom edge of said secondary panel; and a plurality of decorative attachments, each attachment being magnetic whereby each decorative attachment is selectively positionable on said front face of each said secondary panel; and a pair of tertiary panels pivotally coupled to said secondary panels, each tertiary panel having a magnetic front face, a rear face, top and bottom edges, a proximal side edge relative to an adjacently positioned secondary panel extending between said top edge and said bottom edge of said tertiary panel, and a distal side edge relative to said adjacently positioned secondary panel extending between said top edge and said bottom edge of said tertiary panel.

2. The assembly of claim 1, further comprising:

a pair of hinge posts coupled to each side edge of said main panel, said hinge posts being parallel to said main panel; and a pair of post receivers coupled to each said proximal side edge of said secondary panels, each said post receiver having a bottom opening extending into said post receiver, each said post receiver being positioned to receive an associated one of said hinge posts through said bottom opening whereby said secondary panels are pivotally coupled to said main panel.

3. The assembly of claim 1, further including a plurality of footings, each footing being coupled to said bottom edge of an associated one of said secondary panels.

4. The assembly of claim 3, wherein each said secondary panel has two of said footings attached to said bottom edge of said secondary panel.

5. The assembly of claim 1, wherein said rear face of each said secondary panel is magnetic.

6. The assembly of claim 1, further comprising:

a pair of secondary hinge posts coupled to each distal side edge of said secondary panels, said secondary hinge posts being parallel to said secondary panels; and a pair of secondary post receivers coupled to each said proximal side edge of said tertiary panels, each said secondary post receiver having a bottom aperture extending into said secondary post receiver, each said secondary post receiver being positioned to receive an associated one of said secondary hinge posts through said bottom aperture whereby said tertiary panels are pivotally coupled to said secondary panels.

7. The assembly of claim 1, further including a plurality of secondary footings, each secondary footing being coupled to said bottom edge of an associated one of said tertiary panels.

8. The assembly of claim 7, wherein each said tertiary panel has two of said secondary footings attached to said bottom edge of said tertiary panel.

9. The assembly of claim 1, further including a pair of quaternary panels pivotally coupled to said tertiary panels, each quaternary panel having a magnetic front face, a rear face, top and bottom edges, a proximal side edge relative to an adjacently positioned tertiary panel extending between said top edge and said bottom edge of said quaternary panel, and a distal side edge relative to said adjacently positioned tertiary panel extending between said top edge and said bottom edge of said quaternary panel.

10. The assembly of claim 9, further comprising:

a pair of tertiary hinge posts coupled to each distal side edge of said tertiary panels, said tertiary hinge posts being parallel to said tertiary panels; and a pair of tertiary post receivers coupled to each said proximal side edge of said quaternary panels, each said tertiary post receiver having a bottom hole extending into said tertiary post receiver, each said tertiary post receiver being positioned to receive an associated one of said tertiary hinge posts through said bottom hole whereby said quaternary panels are pivotally coupled to said tertiary panels.

11. The assembly of claim 9, further including a plurality of tertiary footings, each tertiary footing being coupled to said bottom edge of an associated one of said quaternary panels.

12. The assembly of claim 11, wherein each said quaternary panel has two of said tertiary footings attached to said bottom edge of said quaternary panel.

13. A play board assembly comprising:

a main panel having a front face, a rear face, a top edge, a bottom edge, and a pair of side edges, each said side edge extending between said top edge of said main panel and said bottom edge of said main panel, said front face of said main panel being magnetic, said rear face being configured for coupling to a support surface;

a pair of secondary panels pivotally coupled to said main panel, each secondary panel having a magnetic front face, a magnetic rear face, top and bottom edges, a proximal side edge relative to said main panel extending between said top edge and said bottom edge of said secondary panel, and a distal side edge relative to said main panel extending between said top edge and said bottom edge of said secondary panel;

a plurality of decorative attachments, each attachment being magnetic whereby each decorative attachment is selectively positionable on said front face of said main panel and said front face of each said secondary panel;

a pair of hinge posts coupled to each side edge of said main panel, said hinge posts being parallel to said main panel;

a pair of post receivers coupled to each said proximal side edge of said secondary panels, each said post receiver having a bottom opening extending into said post receiver, each said post receiver being positioned to receive an associated one of said hinge posts through said bottom opening whereby said secondary panels are pivotally coupled to said main panel;

a plurality of footings, each footing being coupled to said bottom edge of an associated one of said secondary panels, wherein each said secondary panel has two of said footings attached to said bottom edge of said secondary panel;

a pair of tertiary panels pivotally coupled to said secondary panels, each tertiary panel having a magnetic front face, a magnetic rear face, top and bottom edges, a proximal side edge relative to an adjacently positioned secondary panel extending between said top edge and said bottom edge of said tertiary panel, and a distal side edge relative to said adjacently positioned secondary panel extending between said top edge and said bottom edge of said tertiary panel;

a pair of secondary hinge posts coupled to each distal side edge of said secondary panels, said secondary hinge posts being parallel to said secondary panels;

a pair of secondary post receivers coupled to each said proximal side edge of said tertiary panels, each said secondary post receiver having a bottom aperture extending into said secondary post receiver, each said secondary post receiver being positioned to receive an associated one of said secondary hinge posts through said bottom aperture whereby said tertiary panels are pivotally coupled to said secondary panels;

a plurality of secondary footings, each secondary footing being coupled to said bottom edge of an associated one of said tertiary panels, wherein each said tertiary panel has two of said secondary footings attached to said bottom edge of said tertiary panel;

a pair of quaternary panels pivotally coupled to said tertiary panels, each quaternary panel having a magnetic front face, a magnetic rear face, top and bottom edges, a proximal side edge relative to an adjacently positioned tertiary panel extending between said top edge and said bottom edge of said quaternary panel, and a distal side edge relative to said adjacently positioned tertiary panel extending between said top edge and said bottom edge of said quaternary panel;

a pair of tertiary hinge posts coupled to each distal side edge of said tertiary panels, said tertiary hinge posts being parallel to said tertiary panels;

a pair of tertiary post receivers coupled to each said proximal side edge of said quaternary panels, each said tertiary post receiver having a bottom hole extending into said tertiary post receiver, each said tertiary post receiver being positioned to receive an associated one of said tertiary hinge posts through said bottom hole whereby said quaternary panels are pivotally coupled to said tertiary panels; and a plurality of tertiary footings, each tertiary footing being coupled to said bottom edge of an associated one of said quaternary panels, wherein each said quaternary panel has two of said tertiary footings attached to said bottom edge of said quaternary panel.

* * * * *